US009454895B2

(12) United States Patent
Holcombe

(10) Patent No.: US 9,454,895 B2
(45) **Date of Patent: *Sep. 27, 2016**

(54) USE OF OPTICAL REFLECTANCE PROXIMITY DETECTOR FOR NUISANCE MITIGATION IN SMOKE ALARMS

(71) Applicant: Google Inc., Mountain View, CA (US)

(72) Inventor: Wayne T. Holcombe, Mountain View, CA (US)

(73) Assignee: Google Inc., Mountain View, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/594,776

(22) Filed: Jan. 12, 2015

(65) Prior Publication Data

US 2015/0123804 A1 May 7, 2015

Related U.S. Application Data

(63) Continuation of application No. 14/269,688, filed on May 5, 2014, now Pat. No. 8,952,822, which is a continuation of application No. 12/727,983, filed on Mar. 19, 2010, now Pat. No. 8,754,775.

(60) Provisional application No. 61/162,193, filed on Mar. 20, 2009.

(51) Int. Cl.
*G08B 29/18* (2006.01)
*G08B 17/103* (2006.01)
(Continued)

(52) U.S. Cl.
CPC ..... *G08B 29/185* (2013.01); *G08B 3/10* (2013.01); *G08B 17/10* (2013.01); *G08B 17/103* (2013.01); *G08B 17/11* (2013.01)

(58) Field of Classification Search
CPC G08B 17/103; G08B 17/107; G08B 17/113; G08B 29/145; G08B 29/181; G08B 29/185; G08B 17/00; G08B 17/10; G08B 17/11; G08B 3/10; G01N 21/53; G01N 27/66; A01B 12/006
USPC ..... 340/628, 629, 630, 577, 578, 579, 580, 340/581, 582, 583, 584, 309.16, 527; 73/23.33, 23.35, 53.01; 250/200, 554; 116/67 R, 101, 216
See application file for complete search history.

(56) References Cited

U.S. PATENT DOCUMENTS 2,101,637 A 12/1937 Davis
3,934,145 A 1/1976 Dobrzanski et al.
(Continued)

FOREIGN PATENT DOCUMENTS

CA 2202008 2/2000
EP 196069 12/1991
(Continued)

OTHER PUBLICATIONS

Aprilaire Electronic Thermostats Model 8355 User's Manual, Research Products Corporation, Dec. 2000, 16 pages.
(Continued)

*Primary Examiner* — Sisay Yacob
(74) *Attorney, Agent, or Firm* — Kilpatrick Townsend & Stockton LLP

(57) ABSTRACT

Various methods, systems, and devices for identifying a low battery charge of a smoke detector are presented. For example, a device may include a smoke detection sensor that detect smokes and, in response to detecting smoke, generate a smoke detection signal. The device may include battery test circuitry that tests a charge level of a battery installed in the smoke detector device. The device may include an audio output device that outputs a low battery chirp in response to the battery test circuitry determining the charge level of the battery installed in the smoke detector device is low. Also, the device may include a proximity detector that monitors for a wave movement of an object within a distance of the smoke detector device and generates a proximity detection signal when the proximity detector detects the wave movement performed by an object within the distance of the smoke detector device.

20 Claims, 3 Drawing Sheets

(51) Int. Cl.

| | |
|---|---|
| ***G08B 3/10*** | (2006.01) |
| ***G08B 17/10*** | (2006.01) |
| ***G08B 17/11*** | (2006.01) |

(56) References Cited

U.S. PATENT DOCUMENTS 3,991,357 A 11/1976 Kaminski
4,183,290 A 1/1980 Kucharczyk
4,223,831 A 9/1980 Szarka
4,257,039 A 3/1981 Webb et al.
4,313,110 A 1/1982 Subulak et al.
4,335,847 A 6/1982 Levine
4,408,711 A 10/1983 Levine
4,615,380 A 10/1986 Beckey
4,674,027 A 6/1987 Beckey
4,685,614 A 8/1987 Levine
4,751,961 A 6/1988 Levine et al.
4,857,895 A 8/1989 Kaprelian
4,897,798 A 1/1990 Cler
4,901,056 A * 2/1990 Bellavia ..... G08B 29/145 340/12.1
4,975,684 A 12/1990 Guttinger et al.
5,088,645 A 2/1992 Bell
5,211,332 A 5/1993 Adams
5,240,178 A 8/1993 Dewolf et al.
5,244,146 A 9/1993 Jefferson et al.
5,250,904 A * 10/1993 Salander et al. ..... 324/430
5,395,042 A 3/1995 Riley et al.
5,476,221 A 12/1995 Seymour
5,499,196 A 3/1996 Pacheco
5,555,927 A 9/1996 Shah
5,611,484 A 3/1997 Uhrich
5,801,625 A * 9/1998 Wang ..... 340/506
5,808,294 A 9/1998 Neumann
5,902,183 A 5/1999 D'Souza
5,909,378 A 6/1999 De Milleville
5,918,474 A 7/1999 Khanpara et al.
5,933,078 A * 8/1999 O'Donnell ..... G08B 27/00 340/4.2
5,977,964 A 11/1999 Williams et al.
6,062,482 A 5/2000 Gauthier et al.
6,066,843 A 5/2000 Scheremeta
6,095,427 A 8/2000 Hoium et al.
6,098,893 A 8/2000 Berglund et al.
6,111,511 A 8/2000 Sivathanu et al.
6,216,956 B1 4/2001 Ehlers et al.
6,349,883 B1 2/2002 Simmons et al.
6,356,204 B1 3/2002 Guindi et al.
6,370,894 B1 4/2002 Thompson et al.
6,415,205 B1 7/2002 Myron et al.
6,478,233 B1 11/2002 Shah
6,619,055 B1 9/2003 Addy
6,645,066 B2 11/2003 Gutta et al.
6,769,482 B2 8/2004 Wagner et al.
6,990,821 B2 1/2006 Singh et al.
7,024,336 B2 4/2006 Salsbury et al.
7,109,879 B2 9/2006 Stults et al.
7,149,729 B2 12/2006 Kaasten et al.
7,188,482 B2 3/2007 Sadegh et al.
7,379,791 B2 5/2008 Tamarkin et al.
RE40,437 E 7/2008 Rosen
7,469,550 B2 12/2008 Chapman, Jr. et al.
7,579,945 B1 8/2009 Richter et al.
7,623,028 B2 11/2009 Kates
7,644,869 B2 1/2010 Hoglund et al.
7,702,424 B2 4/2010 Cannon et al.
7,784,704 B2 8/2010 Harter
7,802,618 B2 9/2010 Simon et al.
7,848,900 B2 12/2010 Steinberg et al.
7,854,389 B2 12/2010 Ahmed
7,994,928 B2 8/2011 Richmond
8,010,237 B2 8/2011 Cheung et al.
8,016,205 B2 9/2011 Drew
8,019,567 B2 9/2011 Steinberg et al.
8,037,022 B2 10/2011 Rahman et al.
8,090,477 B1 1/2012 Steinberg
8,091,375 B2 1/2012 Crawford
8,098,166 B2 1/2012 Lang
8,131,497 B2 3/2012 Steinberg et al.
8,174,381 B2 5/2012 Imes et al.
8,180,492 B2 5/2012 Steinberg
8,219,249 B2 7/2012 Harrod et al.
8,754,775 B2 6/2014 Holcombe
8,952,822 B2 2/2015 Holcombe
2001/0038337 A1* 11/2001 Wickstead ..... G08B 17/10 340/628
2004/0164238 A1 8/2004 Xu et al.
2004/0249479 A1 12/2004 Shorrock
2005/0090915 A1 4/2005 Geiwitz
2005/0128067 A1 6/2005 Zakrewski
2005/0150968 A1 7/2005 Shearer
2005/0189429 A1 9/2005 Breeden
2005/0192915 A1 9/2005 Ahmed et al.
2005/0280421 A1 12/2005 Yomoda et al.
2006/0186214 A1 8/2006 Simon et al.
2006/0196953 A1 9/2006 Simon et al.
2007/0001860 A1* 1/2007 Frost-Gaskin ..... G08B 17/06 340/577
2007/0080819 A1 4/2007 Marks et al.
2007/0115902 A1 5/2007 Shamoon et al.
2007/0205297 A1 9/2007 Finkam et al.
2007/0222624 A1* 9/2007 Eicken ..... A01K 15/021 340/573.3
2007/0266575 A1 11/2007 Nash
2008/0015742 A1 1/2008 Kulyk et al.
2008/0183335 A1 7/2008 Poth et al.
2008/0191045 A1 8/2008 Harter
2008/0273754 A1 11/2008 Hick et al.
2008/0317292 A1 12/2008 Baker et al.
2009/0171862 A1 7/2009 Harrod et al.
2009/0174562 A1* 7/2009 Jacobus ..... G08B 29/181 340/636.1
2009/0254225 A1 10/2009 Boucher et al.
2009/0259713 A1 10/2009 Blumrich et al.
2009/0297901 A1 12/2009 Kilian et al.
2009/0327354 A1 12/2009 Resnick et al.
2010/0019051 A1 1/2010 Rosen
2010/0025483 A1 2/2010 Hoeynck et al.
2010/0070084 A1 3/2010 Steinberg et al.
2010/0070086 A1 3/2010 Harrod et al.
2010/0070234 A1 3/2010 Steinberg et al.
2010/0084482 A1 4/2010 Kennedy et al.
2010/0167783 A1 7/2010 Alameh et al.
2010/0179704 A1 7/2010 Ozog
2010/0211224 A1 8/2010 Keeling et al.
2010/0238036 A1 9/2010 Holcombe
2010/0262298 A1 10/2010 Johnson et al.
2010/0262299 A1 10/2010 Cheung et al.
2010/0280667 A1 11/2010 Steinberg
2010/0289643 A1 11/2010 Trundle et al.
2010/0308119 A1 12/2010 Steinberg et al.
2010/0318227 A1 12/2010 Steinberg et al.
2011/0046792 A1 2/2011 Imes et al.
2011/0046805 A1 2/2011 Bedros et al.
2011/0046806 A1 2/2011 Nagel et al.
2011/0077896 A1 3/2011 Steinberg et al.
2011/0151837 A1 6/2011 Winbush, III
2011/0160913 A1 6/2011 Parker et al.
2011/0185895 A1 8/2011 Freen
2011/0307103 A1 12/2011 Cheung et al.
2011/0307112 A1 12/2011 Barrilleaux
2012/0017611 A1 1/2012 Coffel et al.
2012/0065935 A1 3/2012 Steinberg et al.
2012/0085831 A1 4/2012 Kopp
2012/0101637 A1 4/2012 Imes et al.
2012/0158350 A1 6/2012 Steinberg et al.
2012/0221151 A1 8/2012 Steinberg
2012/0252430 A1 10/2012 Imes et al.
2014/0240136 A1 8/2014 Holcombe

(56) References Cited

U.S. PATENT DOCUMENTS

FOREIGN PATENT DOCUMENTS

| | | |
|---|---|---|
| JP | 59106311 | 6/1984 |
| JP | 01252850 | 10/1989 |
| JP | 09298780 | 11/1997 |

OTHER PUBLICATIONS

Braeburn 5300 Installer Guide, Braeburn Systems, LLC, Dec. 9, 2009, 10 pages.
Braeburn Model 5200, Braeburn Systems, LLC, Jul. 20, 2011, 11 pages.
Ecobee Smart Si Thermostat Installation Manual, Ecobee, Apr. 3, 2012, 40 pages.
Ecobee Smart Si Thermostat User Manual, Ecobee, Apr. 3, 2012, 44 pages.
Ecobee Smart Thermostat Installation Manual, Jun. 29, 2011, 20 pages.
Ecobee Smart Thermostat User Manual, May 11, 2010, 20 pages.
Electric Heat Lock Out on Heat Pumps, Washington State University Extension Energy Program, Apr. 2010, pp. 1-3.
Honeywell Installation Guide FocusPRO TH6000 Series, Honeywell International, Inc., Jan. 5, 2012, 24 pages.
Honeywell Operating Manual FocusPRO TH6000 Series, Honeywell International, Inc., Mar. 25, 2011, 80 pages.
Honeywell Prestige THX9321-9421 Operating Manual, Honeywell International, Inc., Jul. 6, 2011, 120 pages.
Honeywell THX9321 Prestige 2.0 and TXH9421 Prestige IAQ 2.0 with EIM Product Data, Honeywell International, Inc., 68-0311, Jan. 2012, 126 pages.
Hunter Internet Thermostat Installation Guide, Hunter Fan Co., Aug. 14, 2012, 8 pages.
Introducing the New Smart Si Thermostat, Datasheet [online], retrieved from the Internet: <URL: https://www.ecobee.com/solutions/home/smart-si/> [retrieved on Feb. 25, 2013], Ecobee, Mar. 12, 2012, 4 pages.
Lennox ComfortSense 5000 Owners Guide, Lennox Industries, Inc., Feb. 2008, 32 pages.
Lennox ComfortSense 7000 Owners Guide, Lennox Industries, Inc., May 2009, 15 pages.
Lennox iComfort Manual, Lennox Industries, Inc., Dec. 2010, 20 pages.
Lux PSPU732T Manual, LUX Products Corporation, Jan. 6, 2009, 48 pages.
NetX RP32-Wifi Network Thermostat Consumer Brochure, Network Thermostat, May 2011, 2 pages.
NetX RP32-Wifi Network Thermostat Specification Sheet, Network Thermostat, Feb. 28, 2012, 2 pages.
RobertShaw Product Manual 9620, Maple Chase Company, Jun. 12, 2001, 14 pages.
RobertShaw Product Manual 9825i2, Maple Chase Company, Jul. 17, 2006, 36 pages.
SA720 Smoke Alarm User Manual, First Alert, Aug. 2007, 6 pages.
Smoke Alarm User Manual, Kidde, i9060, Dec. 1, 2009, 2 pages.
SYSTXCCUIZ01-V Infinity Control Installation Instructions, Carrier Corp, May 31, 2012, 20 pages.
T8611G Chronotherm IV Deluxe Programmable Heat Pump Thermostat Product Data, Honeywell International Inc., Oct. 1997, 24 pages.
TB-PAC, TB-PHP, Base Series Programmable Thermostats, Carrier Corp, May 14, 2012, 8 pages.
The Perfect Climate Comfort Center PC8900A W8900A-C Product Data Sheet, Honeywell International Inc., Apr. 2001, 44 pages.
TP-PAC, TP-PHP, TP-NAC, TP-NHP Performance Series AC/HP Thermostat Installation Instructions, Carrier Corp., Sep. 2007, 56 pages.
Trane Communicating Thermostats for Fan Coil, Trane, May 2011, 32 pages.
Trane Communicating Thermostats for Heat Pump Control, Trane, May 2011, 32 pages.
Trane Install XL600 Installation Manual, Trane, Mar. 2006, 16 pages.
Trane XL950 Installation Guide, Trane, Mar. 2011, 20 pages.
Venstar T2900 Manual, Venstar, Inc., Apr. 2008, 113 pages.
Venstar T5800 Manual, Venstar, Inc., Sep. 7, 2011, 63 pages.
VisionPRO TH8000 Series Installation Guide, Honeywell International, Inc., Jan. 2012, 12 pages.
VisionPRO TH8000 Series Operating Manual, Honeywell International, Inc., Mar. 2011, 96 pages.
VisionPRO Wi-Fi Programmable Thermostat User Guide, Honeywell International, Inc., Aug. 2012, 48 pages.
White Rodgers (Emerson) Model 1F81-261 Installation and Operating Instructions, White Rodgers, Apr. 15, 2010, 8 pages.
White Rodgers (Emerson) Model IF98EZ-1621 Homeowner's User Guide, White Rodgers, Jan. 25, 2012, 28 pages.
Allen et al., Real-Time Earthquake Detection and Hazard Assessment by ElarmS Across California, Geophysical Research Letters, vol. 36, L00B08, 2009, pp. 1-6.
Deleeuw, Ecobee WiFi Enabled Smart Thermostat Part 2: The Features Review, retrieved from <URL: http://www.homenetworkenabled.com/content.php?136-ecobee-WiFi-enabled-Smart-Thermostat-Part-2-The-Features-review> [retrieved on Jan. 8, 2013], Dec. 2, 2011, 5 pages.
Gao et al., The Self-Programming Thermostat: Optimizing Setback Schedules Based on Home Occupancy Patterns, In Proceedings of the First ACM Workshop on Embedded Sensing Systems for Energy-Efficiency in Buildings, Nov. 3, 2009, 6 pages.
Loisos et al., Buildings End-Use Energy Efficiency: Alternatives to Compressor Cooling, California Energy Commission, Public Interest Energy Research, Jan. 2000, 80 pages.
Lu et al., The Smart Thermostat: Using Occupancy Sensors to Save Energy in Homes, In Proceedings of the 8th ACM Conference on Embedded Networked Sensor Systems, Nov. 3-5, 2010, pp. 211-224.
Mozer, The Neural Network House: An Environmental that Adapts to its Inhabitants, Proceedings of the American Association for Artificial Intelligence SS-98-02, 1998, pp. 110-114.
Gira. *Installation and user manual: Smoke alarm device Dual/VdS* [Brochure]. Radevormwald, Germany: Gira. Retrieved from the Internet: <URL: http://download.gira.de/data2/23301210.pdf> on Apr. 18, 2013.
Gira. *Gira Dual/VdS smoke alarm: Double safety by measuring heat and scattered light.* [Brochure]. Radevormwald, Germany: Gira. Retrieved from the Internet: <URL: http://www.gira.de/gebaeudetechnik/produkte/sicherheit/rauchmelder/rauchwarnmelderdualvds.html> on Apr. 18, 2013, 14 pages.
Gira. *Gira Dual/VdS smoke alarm, exploded view.* [Brochure]. Radevormwald, Germany: Gira. Retrieved from the Internet: <URL: http:/ /www.gira .de/gebaeudetechn ik/produ kte/sicherheit/rauchmelder/rauchwarn melderdualvds. html?vid = 1145> on Apr. 18, 2013, 7 pages.

* cited by examiner

USE OF OPTICAL REFLECTANCE PROXIMITY DETECTOR FOR NUISANCE MITIGATION IN SMOKE ALARMS

CROSS-REFERENCES TO RELATED APPLICATIONS

This application is a continuation of U.S. application Ser. No. 14/269,688 filed May 5, 2014, and entitled "USE OF OPTICAL REFLECTANCE PROXIMITY DETECTOR FOR NUISANCE MITIGATION IN SMOKE ALARMS," which is a continuation of U.S. application Ser. No. 12/727,983 filed Mar. 19, 2010, and entitled "USE OF OPTICAL REFLECTANCE PROXIMITY DETECTOR FOR NUISANCE MITIGATION IN SMOKE ALARMS," which claims the benefit of U.S. Provisional Application for Patent Ser. No. 61/162,193, filed on Mar. 20, 2009, and entitled "USE OF OPTICAL REFLECTANCE PROXIMITY DETECTOR FOR NUISANCE MITIGATION IN SMOKE ALARMS," the entire disclosures of which are hereby incorporated by reference for all purposes.

TECHNICAL FIELD

The present invention relates to smoke alarms, and more particularly to smoke alarms including proximity detectors for controlling operation of the smoke alarm.

BACKGROUND

Smoke alarms are utilized for detecting and warning the inhabitants of a home or other occupied location of the existence of smoke which may indicate a fire. Upon detection of the smoke by the smoke alarm, the device emits a shrill, loud alarm that notifies all individuals within the area that smoke has been detected and departure from the premises may be necessary.

While the smoke alarms are very effective at notifying individuals of the possible existence of fire that is generating the smoke, certain types of false alarm indications may often be very annoying to a user. These false alarms may be triggered, for example, by smoke generation within the kitchen during preparation of a meal. This may cause the creation of enough smoke that will set off the smoke alarm causing the loud, shrill alarm. In this case, a fire that is dangerous and out of control is not of concern to the residents so the loud, shrill smoke alarm will provide more of an annoyance than a benefit. Presently, there exists no method for easily discontinuing the loud, shrill alarm other than fanning the atmosphere in the area of the smoke alarm in an attempt to remove the smoke from the area that is causing the smoke alarm to activate or removing the battery or house power from the smoke alarm in order to turn it off Removal of the power source may be difficult as smoke alarms are usually mounted upon the ceiling or other high area of the house or building to provide maximum smoke detection capabilities.

An additional problem with existing smoke alarms is the battery check or low battery condition. In smoke alarms that are powered by batteries, it is often necessary to periodically check the battery within the smoke alarm in order to confirm that the battery has sufficient charge. This often requires obtaining a ladder or chair for the user to reach the smoke alarm which has been placed in a substantially high location within the home or building to maximize smoke detection capabilities. The user is required to push a button that is located on the smoke alarm to perform a battery check. An audible signal is provided for an indication of whether or not the battery is in need of replacement.

An additional related problem relates to the low battery condition within a smoke alarm. When the battery reaches a low power condition, the smoke alarm will commonly beep at a low duty cycle of around once per minute. Unfortunately, this beep often occurs in early morning hours when the house temperature is at a minimum and these conditions maximize the low battery condition and increase the likelihood of an alarm. This is of course a most irritating time for this to occur. Additionally, the beep is very difficult to locate since the beep is short and a single high frequency tone. The beep is short to enable up to a week or more of low power battery alert on a mostly depleted battery. The alert transducer uses a single high frequency, typically around 3 kilohertz due to the need to produce a very high output from a small transducer which necessitates the use of a high frequency resonate transducer. Due to the reflections and use of half wavelengths shorter than the distance between the human ears, it is very difficult to localize the source which may present a problem since most homes normally include a number of smoke alarms.

Thus, there is a need to provide an improved method for temporarily mitigating an undesired activation of a smoke alarm and to provide battery check capabilities within the smoke alarm.

SUMMARY

The present invention, as disclosed and described herein, in one aspect thereof, comprises smoke detection circuitry for detecting smoke and generating a detection signal responsive thereto. Proximity detection circuitry generates a proximity detection signal responsive to the detection of an object within in a selected distance of the smoke alarm. Alarm generation circuitry generates an audible alarm responsive to the detection signal. The audible alarm may be deactivated for a predetermined period of time responsive to at least one proximity detection signal.

DETAILED DESCRIPTION

Figure 1:
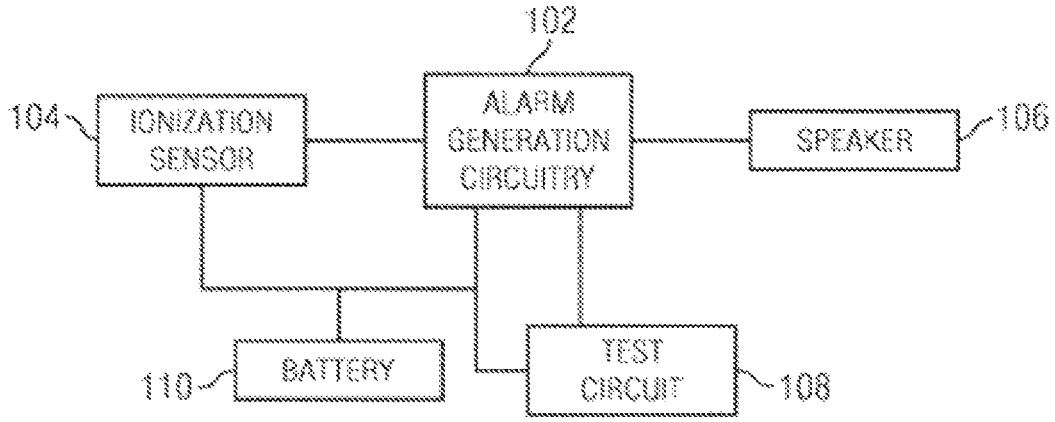
FIG. 1 is a block diagram of a ionization type smoke alarm.

Referring now to the drawings, wherein like reference numbers are used herein to designate like elements throughout, the various views and embodiments of a smoke alarm having proximity detection operation mode are illustrated and described, and other possible embodiments are described. The figures are not necessarily drawn to scale, and in some instances the drawings have been exaggerated and/or simplified in places for illustrative purposes only.

One of ordinary skill in the art will appreciate the many possible applications and variations based on the following examples of possible embodiments.

Referring now to the drawings, and more particularly to FIG. 1, there is illustrated a functional block diagram of a first type of smoke alarm. The smoke alarm of FIG. 1 utilizes ionization detection to detect smoke. The alarm generation circuitry 102 is associated with an ionization sensor 104. The ionization sensor 104 detects particles of smoke using a small amount of radioactive americium 241. The radiation generated by the americium 241 passes through an ionization chamber within the ionization sensor 104. The ionization chamber comprises an air-filled space between two electrodes that permit a small constant current between the electrodes. Any smoke that enters the chamber absorbs the alpha particles emitted by the americium 241 which reduces the ionization and interrupts the current between the electrodes. When this condition is detected, the ionization sensor 104 generates an alarm signal to the alarm circuitry 102 that generates an audible alarm signal that is provided to the speaker 106. Associated with the ionization type smoke alarm is test circuitry 108 that enables testing of the present charge level associated with the battery 110. The battery 110 provides power to the ionization sensor 104, alarm generation circuitry 102, speaker 106 and test circuit 108 to power the smoke alarm.

Figure 2:
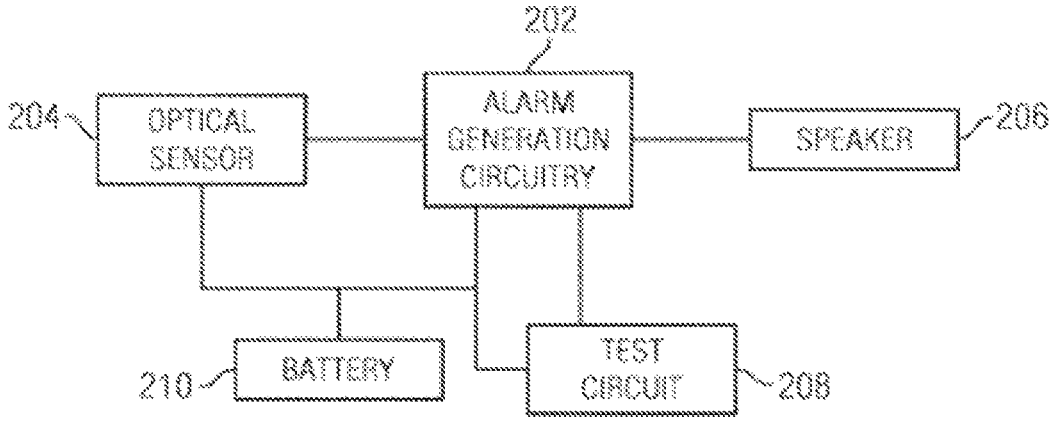
FIG. 2 is a block diagram of an optical type smoke alarm.

Referring now also to FIG. 2, there is illustrated an alternative type of smoke alarm circuitry comprising an optical smoke alarm. The optical smoke alarm also includes alarm generation circuitry 202 that is responsive to smoke detection signals provided by an optical sensor 204. The optical sensor 204 includes a light sensor that includes a light source which may comprise an incandescent bulb or infrared LED, a lens to collimate the light into a beam and a photo diode or other photoelectric sensor for detecting light from the light source. In the absence of smoke, the light passes in front of the detector in a straight line. When smoke enters the optical chamber of the optical sensor 204 across the path of the light beam, some light is scattered by the smoke particles redirecting them at the photo diode or photo sensor, and thus triggering generation of an alarm signal to the alarm circuitry 202. The alarm generation circuitry 202 will generate the audible alarm signal to the speaker 206 associated with the alarm circuitry 202. As with the ionization circuit, the optical smoke alarm utilizes a test circuit 208 to test the charge on the battery 210. The battery 210 is responsible for powering all of the components of the optical smoke alarm including the alarm circuitry 202, optical sensor 204, speaker 206 and test circuit 208.

As described previously, some issues arising with existing smoke alarms, be they ionization or optical type smoke alarms, arise from the creation of false alarm situations such as, for example, when a small amount of smoke is created within the kitchen due to burning toast, food falling on the heating element of the oven, etc., or the ability to quickly and easily check the battery charge using the test circuitry. Presently, mitigation of an alarm requires disconnection of the power source to the smoke alarm in order to discontinue an undesired alarm. Additionally, any type of test of the battery charge requires pushing of a button on the external surface of the smoke alarm that requires the user to be able to physically touch the smoke alarm. This often presents a great challenge since either removing power sources to discontinue an undesired alarm or pressing a button to perform battery test operations require the user to get out a ladder or stand on a chair to access the smoke alarm placed in a high location to ensure its optimal performance.

Figure 3:
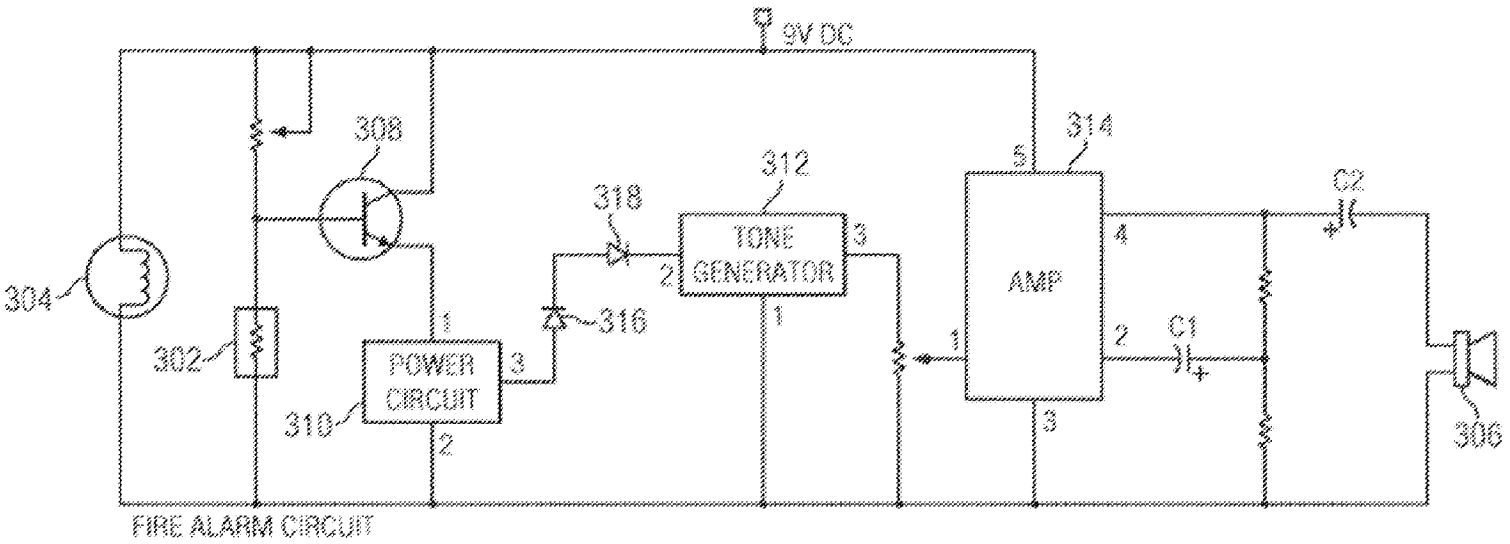
FIG. 3 is a more detailed circuit diagram of an optical type smoke alarm.

FIG. 3 illustrates a schematic diagram of an optical smoke detection alarm based upon an LDR (light detecting resistor) 302 and lamp 304 pair for sensing smoke. The alarm works by sensing the smoke produced during a fire. The circuit produces an audible alarm from speaker 306 when smoke is detected. When there is no smoke, the light from the lamp 304 falls directly upon the LDR 302. The LDR resistance will be low, and the voltage across the LDR will be below 0.6 volts. Transistor 308 will be turned off in this state and the circuit is inactive. When there is sufficient smoke to mask the light from the lamp 304 falling on the LDR 302, the LDR 302 resistance increases and so does the voltage across the LDR. This will cause the voltage at the gate of transistor 308 to increase and turn on transistor 308. This provides a voltage to power circuit 310 which generates a 5 volt signal to a tone generator 312. The tone signal from tone generator 312 is amplified by an amplifier 314 which is used to drive the speaker 306. Diodes 316 and 318 are used to drop the voltage input to the tone generator 312 from the power circuit 310.

Figure 4:
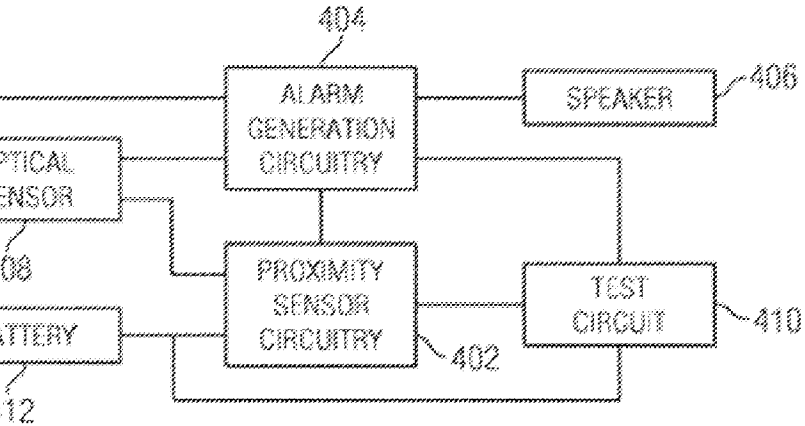
FIG. 4 illustrates a block diagram of a smoke alarm including proximity sensor operation capabilities according to the present disclosure.

Referring now to FIG. 4, there is illustrated a block diagram of a circuit which enables a user to utilize proximity detection circuitry for temporarily abating an undesired alarm or performing battery test operations rather than using previously described processes. While the implementation with respect to FIG. 4 describes the use of proximity sensor circuitry 402 within an optical type smoke alarm, the proximity sensor circuitry 402 could also be implemented within the ionization type circuitry described hereinabove. The smoke alarm detection capabilities of the smoke alarm of FIG. 4 operate in a similar manner to the optical alarm described previously. Alarm generation circuitry 404 generates alarm signals to a speaker 406 responsive to smoke detection signals received from optical sensor 408. The optical sensor 408 generates the smoke detection signal to the alarm generation circuitry 404 in the same manner as that described previously with respect to the optical smoke alarm of FIG. 2.

The optical sensor 408 in addition to detecting smoke is used for detecting the proximity of a user's hand or other item in conjunction with the proximity sensor circuitry 402. The proximity sensor circuitry 402 detects when a hand or for example, a broom or other item are being waved in close proximity to the smoke alarm. The optical sensor 408 comprises a short-range (approximately 6 inches) optical proximity sensor that in conjunction with the proximity sensor circuitry 402 may be used to control operations of the smoke alarm with either the wave of a hand or some other readily available object such as a broom. The test circuitry 410 enables testing of the charge within a battery 412. The battery 412 provides power to each of the components within the smoke alarm circuit.

Figure 5:
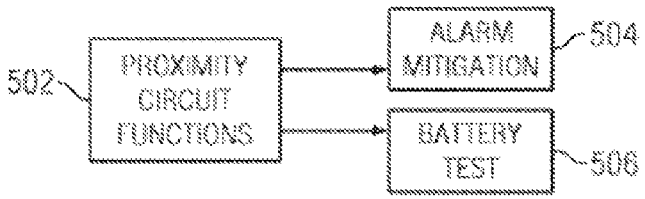
FIG. 5 illustrates the various functionalities associated with the smoke alarm including proximity sensor modes of operation.

Utilizing a combination of the proximity sensor circuitry 402, optical sensor 408 and alarm generation circuitry 404, the smoke alarm may provide a number of proximity controller functionalities. These are generally illustrated in FIG. 5. A number of proximity controlled functions 502 may be provided using the proximity sensor 402. The proximity controlled functions include the alarm mitigation function 504 and the battery test function 506. The alarm mitigation function 504 enables a temporary discontinuation of the audible alarm in situations when an undesired activation of the alarm has occurred. This would occur for example, when a small amount of smoke created within a kitchen that does not indicate a fire or emergency condition has been created. The proximity sensor of the smoke alarm is activated when an object such as a hand or a broom is brought close to the optical sensor 408. If the smoke alarm has been activated due to kitchen smoke or other situations that have been resolved by human intervention, proximity detection would enable the user to disable the smoke alarm for a short period of time, such as 3 minutes, to allow the area around the smoke alarm to air out. A double wave or other more complex detection by the proximity sensor circuitry 402 and optical sensor 408 may be accomplished in a short period of time, such as less than 10 seconds in order to enable assurances that the detection was for a desired mitigation of the alarm and not some type of random event occurring during actual smoke detection.

In order to assist a user in temporarily mitigating the alarm, a momentary change in the audible alarm would be desirable for each proximity event that has been detected by the optical sensor 408 and proximity sensor circuit 402. This would assist the user in knowing whether they had accurately or inaccurately waved their hand or broom in the area of the smoke alarm and provide for an audible indication of aiming feedback with respect to the proximity detection. After the appropriate combination of proximity detection events have been detected by the optical sensor 408 and proximity sensor circuit 402, the audible alarm would be temporarily discontinued.

The smoke alarm commonly beeps at a low duty cycle of around once per minute when the battery 412 has its charge fall below a predetermined level. These beeps can often be very difficult to locate since the beep is short and comprises a single high frequency tone. The beep is short to enable up to a week or more of low battery alerts to be created on an almost depleted battery. The alert transducer uses a single high frequency chirp typically around 3 kilohertz due to the need to produce a very high output from a small transducer. This necessitates the use of a high frequency resonate transducer. Due to the reflections and the use of a half wavelength shorter than the distance between the human ear, it is often very difficult to locate the source requiring the user to check each smoke alarm within the house requiring a great deal of time.

The battery test functionality 506 enables a battery test operation to be performed on the battery 412 within the smoke alarm without having to manually press a button on the smoke alarm. The battery test functionality 506 can be utilized in two situations. When a low battery charge chirp is being emitted by the smoke alarm, the low battery test functionality 506 may be used to determine whether a particular smoke alarm has a low battery charge or whether the battery presently has sufficient charge. The battery test functionality 506 would similarly be useful for performing the periodic battery charge tests that are required to ensure the smoke alarm is in working operation.

By utilizing the proximity sensor circuitry 402, if the smoke alarm has not been activated to indicate detection of smoke, the detection of a single proximity event from a hand or broom by the optical sensor 408 and proximity sensor circuitry 402 initiates a battery check test. If the battery 412 is weak, the test circuitry 410 will cause the production of a distinctive series of beeps or a distinctive tone to indicate a dying battery. If the battery 412 is sufficiently charged, a single short beep of a different tone may be created. Thus, if a user hears a low battery beep, they can use their broom or hand to quickly and easily check all of the smoke alarms within their home without having to climb up on a chair or ladder or remove the devices in order to press a detection button upon the smoke alarm.

As described previously, smoke alarms generally use either an ionization chamber or optical smoke detection circuitry or a combination of both to detect smoke. These differing techniques have distinct advantages and disadvantages. However, a high performance optical reflective detector implemented within the circuit of FIG. 4 including proximity sensor circuitry 402 can readily be adapted to detect reflectance from smoke and to provide proximity detection data since both detections are equivalent low reflectance functions. The proximity detector is more sophisticated since it must deal with ambient light while the conventional optical smoke detector does not have to cancel ambient light since it looks for reflections from smoke in an optically baffled compartment which blocks out ambient light but allows the entry of smoke. A reflectance proximity detector can drive two different LEDs, one for proximity detection and the other for smoke detection within the optical sensor 408. A light pipe can provide a signal from the baffled smoke detector and also from the outside proximity view. Depending on which LED is driven, the proximity detector is either for reflectance above a threshold for either the proximity detection or for smoke and of course giving a different alarm response. Optionally, an auxiliary photo diode can be used for the smoke detector portion to avoid artifacts or issues arising from ambient light. Because the proximity detection technology uses a low duty cycle controller to make proximity detection measurements every second or so, this low duty cycle controller can also be used for the low duty cycle smoke controller which is beneficial for reducing battery charge consumption.

Figure 6:
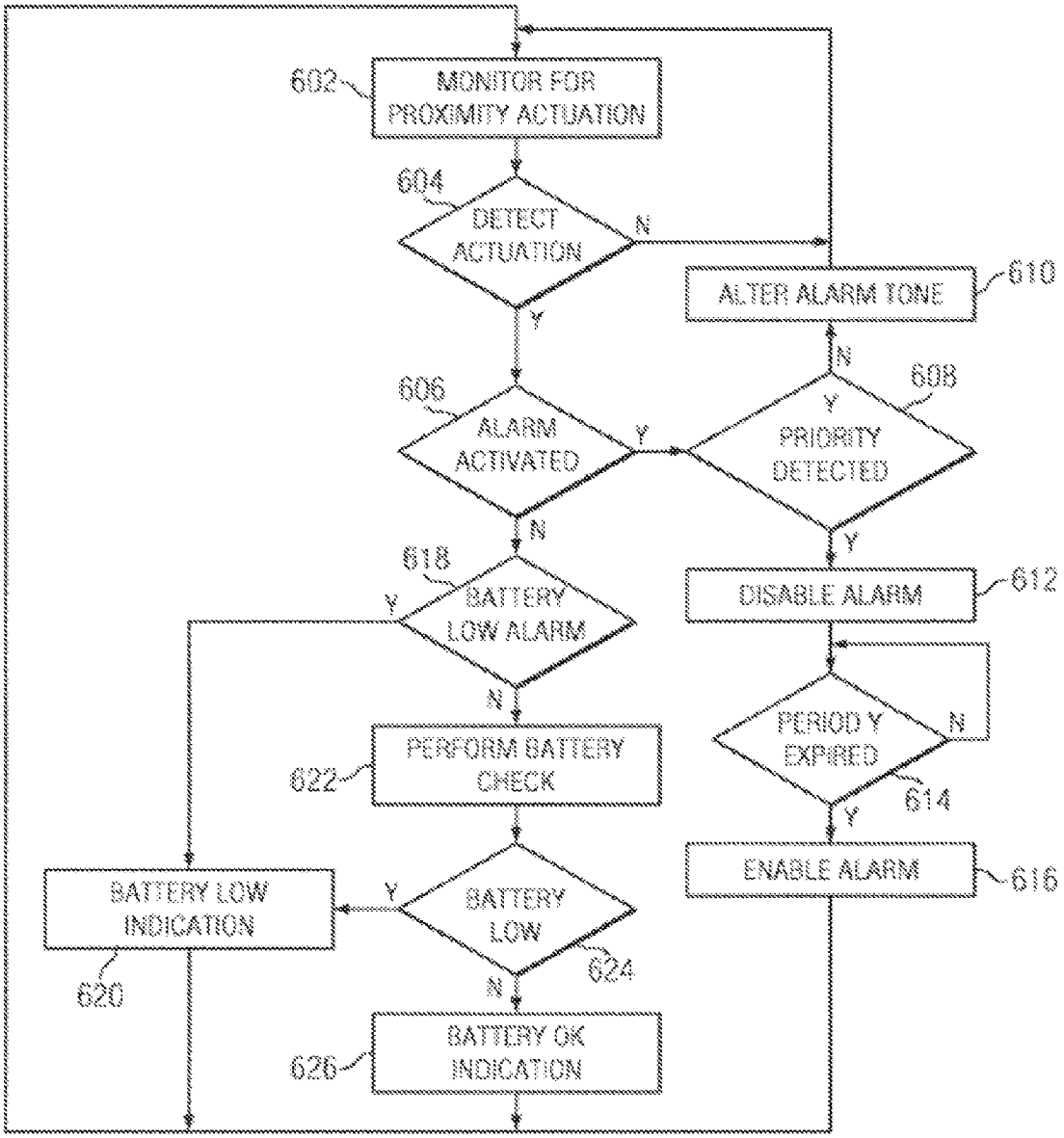
FIG. 6 is a flow diagram describing the operation of the smoke alarm including proximity sensor modes of operation.

Referring now to FIG. 6, there is illustrated a flow diagram describing the operation of the proximity detection controlled smoke alarm. Initially, at step 602, the optical sensor 408 and proximity sensor circuitry 402 monitor for a proximity actuation. Inquiry step 604 determines whether there has been a detection of a proximity actuation. If not, control passes back to step 602 to continue monitoring for a proximity actuation. Once a proximity actuation is detected, inquiry step 606 determines if the smoke alarm is presently activated. If so, control passes to inquiry step 608 which determines if a predetermined number of proximity activations have been detected. If not, the alarm tone provided by the smoke alarm may be altered at step 610 and control returns back to step 602 to continue monitoring for additional proximity activations. If inquiry step 608 determines that a predetermined number of proximity actuations have been detected, the smoke alarm is disabled at step 612. Inquiry step 614 monitors for the expiration of a selected period of time. If the period of time has not yet expired, the process remains at inquiry step 614. Once the predetermined period of time has expired, control passes to step 616, wherein the smoke alarm is re-enabled and control passes back to step 602 to continue monitoring for proximity actuation. Once the alarm is re-enabled, the smoke detector can monitor for smoke and react accordingly.

If inquiry step 606 determines that the smoke alarm is not presently activated, control passes to inquiry step 618 to make a determination if the battery low alarm is presently active for the smoke alarm. If so, a battery low indication is audibly provided from the smoke alarm at step 620. If the battery low alarm has not been activated, a battery charge check is performed at step 622. Inquiry step 624 determines whether the battery is in a low charge condition. If not, a battery OK audible indication is provided at step 626 to indicate a sufficient charge and control passes back to step 602. If inquiry step 624 determines that the battery is in a low charge condition, the battery low indication is provided at step 620 before control passes back to step 602 to monitor for additional proximity actuations.

The above-described solution provides a low cost intuitive battery alarm control system to limit nuisance alarms within the smoke alarm and enables ease of battery charge checking using a proximity detection control process. The system also improves safety since users often remove batteries or take down smoke alarms that are producing spurious alarms or low battery beeping alarms. Users will also take down unaffected smoke alarms since the user cannot localize the beep associated with the alarm and then do not replace the alarm. Consumers do not check battery levels if the smoke alarm is out of reach. Additionally, use of an optical reflection proximity control system is better than a capacitive proximity system since convenient hand extension devices such as brooms would not work to activate a capacitive sensor which senses a conductive object such as the human hand or body.

It will be appreciated by those skilled in the art having the benefit of this disclosure that this smoke alarm having proximity detection operation mode provides an improved method for controlling operation of a smoke alarm. It should be understood that the drawings and detailed description herein are to be regarded in an illustrative rather than a restrictive manner, and are not intended to be limiting to the particular forms and examples disclosed. On the contrary, included are any further modifications, changes, rearrangements, substitutions, alternatives, design choices, and embodiments apparent to those of ordinary skill in the art, without departing from the spirit and scope hereof, as defined by the following claims. Thus, it is intended that the following claims be interpreted to embrace all such further modifications, changes, rearrangements, substitutions, alternatives, design choices, and embodiments.

What is claimed is:

1. A method for identifying a smoke detector having a low battery charge, the method comprising:

hearing, by a user from an unlocated smoke detector of a plurality of smoke detectors, a low battery chirp;

moving, by the user, in proximity to a first smoke detector of the plurality of smoke detectors, a first object to trigger a proximity-induced battery check of the first smoke detector, wherein the proximity-induced battery check of the first smoke detector is triggered using proximity sensor circuitry of the first smoke detector that uses electromagnetic reflection to detect a presence of the first object;

determining, by the first smoke detector, a first battery charge condition in response to detecting the first object moved in proximity to the first smoke detector;

outputting, by the first smoke detector, a first auditory indication indicative of the first battery charge condition being sufficient in response to the first object moved in proximity to the first smoke detector;

moving, by the user, in proximity to a second smoke detector of the plurality of smoke detectors, a second object to trigger a proximity-induced battery check of the second smoke detector, wherein the proximity-induced battery check of the first smoke detector is triggered using proximity sensor circuitry of the second smoke detector that uses electromagnetic reflection to detect a presence of the second object;

determining, by the second smoke detector, a second battery charge condition in response to the second object moved in proximity to the second smoke detector; and outputting, by the second smoke detector, a second auditory indication indicative of the second battery charge condition being low in response to the second object moved in proximity to the second smoke detector, wherein the second smoke detector is identified by the user as the unlocated smoke detector.

2. The method for identifying the smoke detector having the low battery charge of claim 1, further comprising:

outputting, by the second smoke detector, a low battery chirp periodically, wherein the low battery chirp has a frequency such that a half wavelength of the low battery chirp is shorter than a distance between the two ears of the user.

3. The method for identifying the smoke detector having the low battery charge of claim 1, wherein determining, by the first smoke detector, the first battery charge condition in response to detecting the first object moved in proximity to the first smoke detector comprises:

determining, by the first smoke detector, that a first battery low alarm of the first smoke detector is inactive.

4. The method for identifying the smoke detector having the low battery charge of claim 3, wherein determining, by the first smoke detector, the first battery charge condition in response to detecting the first object moved in proximity to the first smoke detector further comprises:

performing, by the first smoke detector, a battery charge check in response to the first smoke detector determining that the first battery low alarm of the first smoke detector is inactive.

5. The method for identifying the smoke detector having the low battery charge of claim 3, wherein determining, by the second smoke detector, the second battery charge condition in response to detecting the second object moved in proximity to the second smoke detector comprises:

determining, by the second smoke detector, that a second battery low alarm of the second smoke detector is active.

6. The method for identifying the smoke detector having the low battery charge of claim 1, further comprising:

detecting, by the first smoke detector, proximity actuation caused by the first object moving in proximity to the first smoke detector;

in response to the proximity actuation, determining whether a first smoke alarm of the first smoke detector is active, wherein:

the first smoke alarm is active when smoke is detected by the first smoke detector, and determining the first battery charge condition occurs in response to determining that the first smoke alarm is not active.

7. The method for identifying the smoke detector having the low battery charge of claim 6, further comprising:

detecting, by the second smoke detector, proximity actuation caused by the second object moving in proximity to the second smoke detector;

in response to the proximity actuation, determining whether a second smoke alarm of the second smoke detector is active, wherein:

the second smoke alarm is active when smoke is detected by the second smoke detector, and determining the second battery charge condition occurs in response to determining that the second smoke alarm is not active.

8. The method for identifying the smoke detector having the low battery charge of claim 1, wherein the first object and the second object are the same object.

9. The method for identifying the smoke detector having the low battery charge of claim 8, wherein the first object and the second object are a hand of the user.

10. A smoke detector device, comprising:

a smoke detection sensor that detect smokes and, in response to detecting smoke, generate a smoke detection signal;

battery test circuitry that tests a charge level of a battery installed in the smoke detector device;

an audio output device that outputs a low battery chirp in response to the battery test circuitry determining the charge level of the battery installed in the smoke detector device is low; and a proximity detector that monitors for of an object physically waved within a distance of the smoke detector device and generates a proximity detection signal when the proximity detector detects the wave movement performed by as the object within the distance of the smoke detector device, wherein:

the object is not actively self-illuminated; and the proximity detection signal generated by the proximity detector causes a low battery audible indication to be output by the audio output device when the battery test circuitry indicates that the charge level of the battery is low.

11. The smoke detector device of claim 10, wherein the smoke detection sensor, the battery test circuitry, the audio output device, and the proximity detector are powered by the battery installed in the smoke detector device.

12. The smoke detector device of claim 10, wherein the audio output device generates the low battery chirp at a frequency such that a half wavelength of the low battery chirp is shorter than a distance between two ears of a person.

13. The smoke detector device of claim 10, wherein the battery test circuitry determines if a low battery alarm of the smoke detector device is active in response to the proximity detector detecting the wave movement of the object.

14. The smoke detector device of claim 13, wherein the battery test circuitry performs a battery charge check in response to determining that the low battery alarm is inactive.

15. The smoke detector device of claim 10, wherein the smoke detector device, in response to the proximity detector detecting the wave movement of the object, determines whether a smoke alarm of the smoke detector device is active, wherein the smoke alarm is active when smoke is detected by the smoke detector device.

16. The smoke detector device of claim 15, wherein the battery test circuitry determines the charge level of the battery in response to determining that the smoke alarm is not active and the wave movement being detected by the proximity detector.

17. The smoke detector device of claim 15, wherein the object is a hand, such that the proximity detector is configured to monitor for the wave movement of the hand within the distance of the smoke detector device.

18. A method for identifying a low battery charge condition of a smoke detector device, the method comprising:

outputting a low battery chirp at a periodic interval indicative of the low battery charge condition of a battery installed in the smoke detector device;

monitoring for an object being waved within a distance of the smoke detector device using a proximity detector, wherein the smoke detector device uses proximity sensor circuitry that detects electromagnetic reflection of the object being waved within the distance of the smoke detector device;

generating a proximity detection signal in response to the wave movement being detected within the distance of the smoke detector device by the proximity detector;

determining, using battery test circuitry, the low battery charge condition is present in response to the proximity detection signal; and outputting, an auditory indication of the low battery charge condition in response to the proximity detection signal and determining that the low battery charge condition is present, wherein the auditory indication of the low battery charge condition is distinct from the low battery chirp.

19. The method for identifying the low battery charge of the smoke detector device of claim 18, wherein determining, using the battery test circuitry, the low battery charge condition is present in response to detecting the wave movement comprises:

determining that a battery low alarm of the smoke detector device is active.

20. The method for identifying the low battery charge of the smoke detector device of claim 18, further comprising:

determining whether a smoke alarm of the smoke detector device is active in response to the wave movement being detected, wherein:

the smoke alarm is active when smoke is detected by the smoke detector device, and determining, using the battery test circuitry, the low battery charge condition is performed in response to determining the smoke alarm is inactive.

* * * * *